United States Patent [19]

Brown

[11] Patent Number: 5,018,747

[45] Date of Patent: May 28, 1991

[54] BLADED DART PROJECTILE

[76] Inventor: Jim W. Brown, Rte. 1, Box 182, Kinston, Ala. 36453

[21] Appl. No.: 489,031

[22] Filed: Mar. 6, 1990

[51] Int. Cl.[5] ..... F42B 6/08

[52] U.S. Cl. ..... 273/422; 124/20.3; 124/91

[58] Field of Search ..... 273/416, 419, 420, 421, 273/422

[56] References Cited

U.S. PATENT DOCUMENTS

| | | | |
|---|---|---|---|
| 272,418 | 2/1883 | Eger | 273/420 X |
| 1,545,476 | 7/1925 | Austerman | 273/416 |
| 2,499,029 | 2/1950 | McElroy | 273/420 |
| 2,912,247 | 11/1959 | Doonan | 273/422 |
| 2,970,839 | 2/1961 | Halverson | 273/416 |
| 3,238,935 | 3/1966 | Stanaland | 273/416 X |
| 3,749,076 | 7/1973 | Suski et al. | 273/416 X |
| 3,834,368 | 9/1974 | Geiger | 273/423 X |
| 4,151,825 | 5/1979 | Cook | 273/416 X |
| 4,381,866 | 5/1983 | Simo | 273/422 |
| 4,468,038 | 8/1984 | Saunders | 273/422 |
| 4,643,435 | 2/1987 | Musacchia | 273/422 |
| 4,656,994 | 4/1987 | Jenks | 273/416 X |
| 4,823,762 | 4/1989 | Pugh | 273/416 X |

*Primary Examiner*—Paul E. Shapiro

*Attorney, Agent, or Firm*—Richard C. Litman

[57] ABSTRACT

The bladed projectile dart disclosed has a bladed head that has a plurality of separable blades that allow for individual replacement. The dart has a hollow shaft that surrounds a draw line which allows for pulling back the projectile when it is mounted in a special slingshot launching device. The draw line is attached at one end to a hub that maintains the blades in formation. The blades are detachable from this hub when the head is lodged in a target. The other end of the blades have a pointed cap that is threadedly mounted to the blade tips. Also described are various launching mechanisms for launching the darts.

6 Claims, 2 Drawing Sheets

BLADED DART PROJECTILE

BACKGROUND OF THE INVENTION

1. Field of the Invention

The present invention relates to hurled implements of a sharpened variety. In particular, it relates to darts having bladed heads and elongated shafts. This dart is capable of being hurled or fired from a specially designed slingshot. This dart is equipped with a special engagement between the slingshot and the dart for drawings and releasing. The dart can be equipped with a special drawstring to that it can be pulled back in the slingshot for firing at the appropriate target.

Many manually drawn weapons such as compound bows and related devices require relatively high strength from the user of the weapon in order to gain the maximum force possible with the weapon. Traditionally, it has been standard procedure to draw a bowstring, slingshot sling or the like with the fingers of one hand. However, this requires a tremendous amount of strength from the fingers and it is very difficult for the user to simultaneously provide the required accuracy.

To overcome this limitation, many persons are using a mechanical release devvice which may be secured to the wrist and releases the bowstring or sling with a trigger, thus eliminating the need for very high finger strength. However, such devices cannot be attached directly to an arrow or projectile, but only to a bowstring. This prevents the use of such mechanical release devices with other types of manually drawn weapons, such as various types of slingshots. In order to use such a mechanical release means directly with a projectile, the projectile would require a special provision in order for such a mechanical release device to be directly attachable. The present invention provides such release means in its various embodiments.

2. Description of the Prior Art

The following patents are felt to be related to, but do not disclose the present invention, whether taken singly or in combination.

U.S. Pat. No. 3,401,938 issued to Bear discloses an arrow with a detachable head threadedly mounted on a hollow shaft by means of an anchor therein. The blades on this device are not separable as they are on the applicant's dart projectile.

U.S. Pat. No. 4,109,915 issued to Bottelsen discloses a dart that can fall apart upon penetration-induced impact, leaving the detachable point in the target. Again, the device disclosed by this patent does not use separable blades that mount into a hub on the end of the shaft.

U.S. Pat. No. 4,795,165 issued to Tehan discloses a foldable arrow with a hollow shaft the two sections of which are held together by a rope secured therein.

None of above patents addresses a dart having means to pull the dart back in a launching device that is attached to the head of the dart. None of the above cited references disclose a projectile head comprised of a plurality of separable blades attached together at a central hub. This separability of blades allows for replacing damaged blades without having to replace the entire head of the dart. The head is easily released upon being retained in an impacted object when the special launching engagement is used. The head having the blades disconnects from the shaft without great effort.

SUMMARY OF THE INVENTION

The present invention is made up of a shaft having the conventional flight feathers on the end opposite the bladed head. The head it self is detachably affixed to the shaft. The head is formed by a plurality of sharpened blades that are mounted to a hub on the shaft. At the distal end of the head is a threaded cap that serves to retain the blades tohgether. This cap serves as the pointed tip of the dart.

The shaft itself is hollow to allow a wire to traverse the length of the shaft from inside. One end of the wire is attached to the blade hub. The other opposite end of the wire leads out the other end of the shaft to a ring that can ber grasped to pull back the dart that is mounted in a launching device. The back of the blades fit against a special ring or collar that serves to mount the dart in a slingshot launching device.

Accordingly, it is an object of the present invention to provide a bladed projectile dart for use with a slingshot launching device.

It is one object of the present invention to provide a bladed dart projectile that has a removable impact head comprised of separable blades. It is another object of the present invention to provide a bladed dart projectile that has a hollow shaft.

It is a further object of the present invention to provide a bladed dart projectile wherein the blades abut against a launching mechanism.

It is another object of the present invention to provide a bladed dart projectile wherein a special collar disposed on the shaft abuts against the launching mechanism.

It is an object of the present invention to provide a bladed dart projectile wherein the shaft abuts against a launching mechanism.

It is yet another object of the present invention to provide a bladed dart projectile having a grasping device that allows the dart to be pulled back in a tension launching device.

It is a still further object of the invention to provide a bladed dart projectile having a pull line disposed through the hollow shaft and attached adjacent the bladed head.

It is a further object of the invention to provide a bladed dart projectile having threading on the end of the blades allowing for pointed cap to be mounted on the end.

These and other objects of the present invention will become readily apparent upon further review of the following specification and drawings.

BRIEF DESCRIPTION OF THE DRAWINGS

Similar reference characters denote corresponding features consistently throughout the attached drawings.

A DETAILED DESCRIPTION OF THE PREFERRED EMBODIMENT

Figure 1:
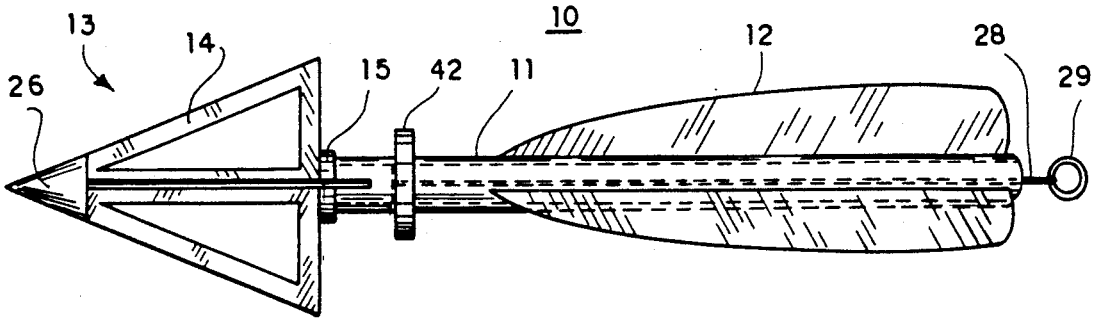
FIG. 1 shows a view in partial cross-section of the bladed dart projectile.

The present invention of a bladed dart projectile 10 as shown in FIG. 1 comprises an elongated shaft 11 having the usual plurality of flight feathers 12 needed to keep the dart on a straight path when it is launched. The common number of feathers used on such projectiles is either three or four. The shaft 11 itself is hollow as will be explained below in this description. Shafts of this sort are usually constructed of aluminum, wood or Fiberglas as is common for conventional arrows.

Attached at one end of the shaft 11 is the projectile head 13. This projectile head 13 includes a plurality of separable blades 14 mounted into a plug 15 that serves as a hub for the blades 14 which is best shown in FIG. 3. This hub 15 is solidly affixed within the open end of the shaft 11 by means of a tight friction fit or adhesive around the interface between the hub 15 and the shaft 11. The face 16 of the hub has a cross pattern of slots or depressions 17 that allows the blades 14 to be inserted into the hub 15. The hub 15 can be made of hard rubber or plastic so that the slots 17 have some resiliency and can produce a friction grip. The blades have extensions 18 that fit within these slots 17. The blades are easily removable from these slots 17 as they are not locked in. This allows for the head 13 of the projectile to easily disengage from the shaft when the head 13 is embedded within a target. The shaft 11 can be reloaded with a new projectile head 13 if the original is lost.

The blades 14 themselves are made of cast or forged steel or other suitable metal. The edges 21 are sharpened as is usual as a hunting arrow normally is to enhance it penetration capability. The tips have an elongated protrusion 23. When all blades 14 are together in formation they form a four branched shaft 24. One this shaft are screw threads 25 for mounting the pointed tip 26. The tip 26 has a reciprocal cavity 27 that is threaded to fit over the shaft 24. This threaded shaft and tip 24,26 serve to maintain the blades 14 together when the head 13 is disengaged from the shaft 11.

The hollow shaft 11 has disposed inside a pull line 28 that is attached at one end to the hub 15. This attachment can be done by soldering a wire to the hub plug 15 if it happens to be metal or tying a flexible line to a small ring on the hub 15. At the other end of the pull line 28 is a ring or similar grasping means 29 that allows the line 28 to be held and pulled back on in order to apply pressure to a launching means. The pull line 28 should be strong enough to withstand up to 80 pounds of tension repeatedly applied. This is so that the projectile 10 can be used repeatedly in a launching device as described below.

Figure 3A:
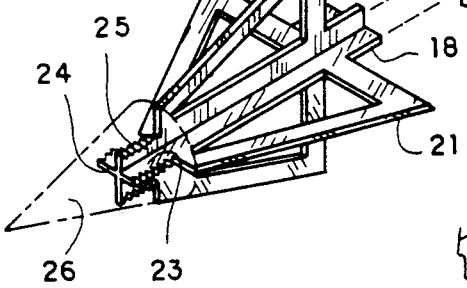
FIG. 3*a* shows a perspective view of the dart head mounted in the special launching device.
Figure 3A:
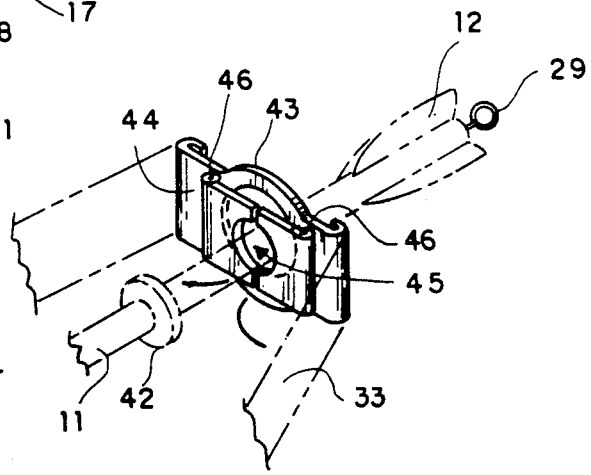
Figure 3B:
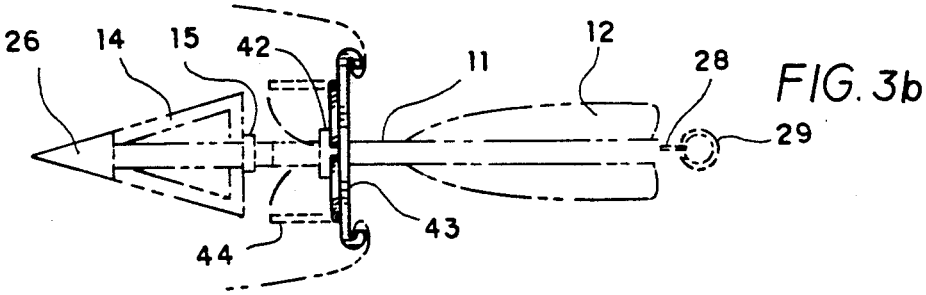
FIG. 3*b* shows a top view of the dart head mounted in the special launching device.

A way of mounting the dart 10 is illustrated in FIGS. 3*a* and 3*b*. A special collar 42 is shown which abuts a seating ring 43 on the sling shot 33. The seating ring has hinged panels 44 on either side that lay flat against the ring 43 when the collar 42 of the dart 10 abuts against the panels 44 with the shaft disposed through a central aperture 45. Upon release of the tensioned slingshot 33, the panels 44 swing foward on their hinges 46, as shown in FIG. 3*b*, to release the entire dart through the ring 43.

Figure 2:
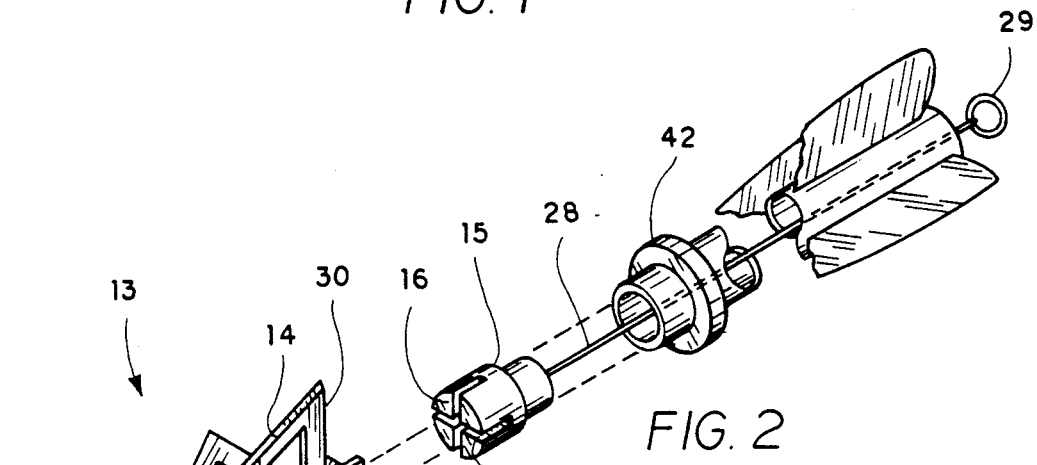
FIG. 2 shows an exploded view of the impact head of the dart detailing the separable blades.
Figure 4A:
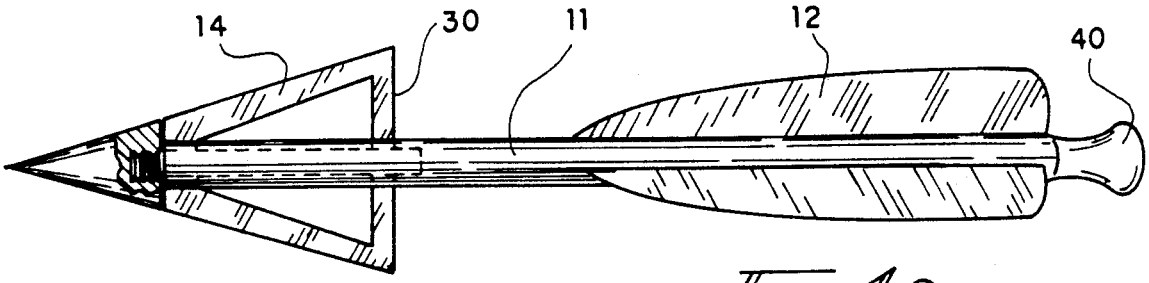
FIG. 4*a* shows a side view of an alternate embodiment of the dart projectile having a different head portion.
Figure 4B:
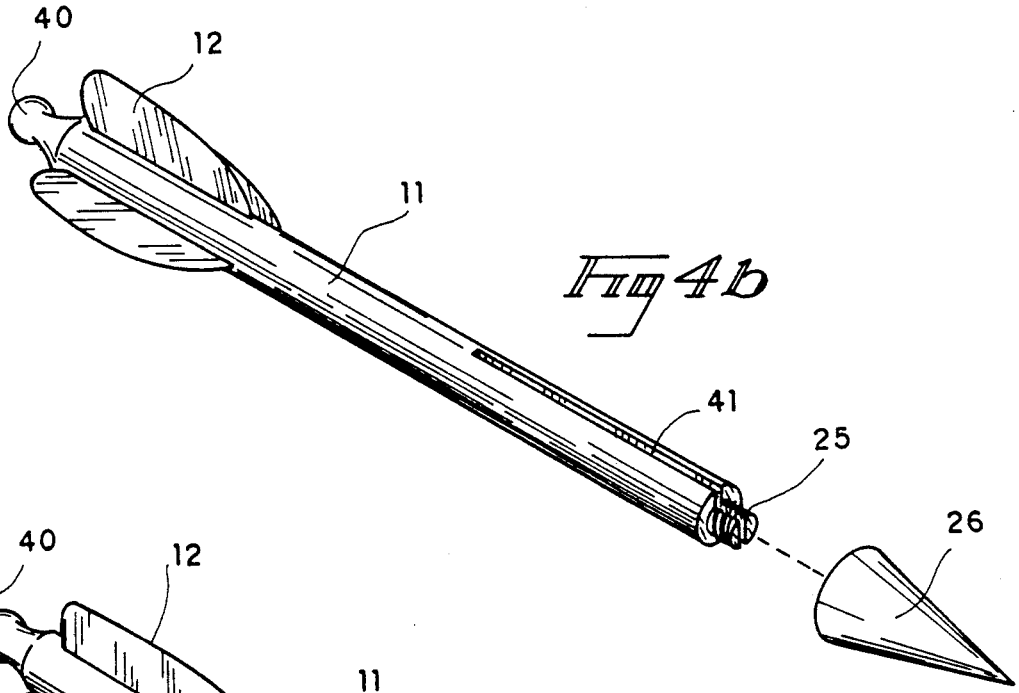
FIG. 4*b* shows an exploded perspective view.

An alternate blade 14 and head 13 arrangement is illustrated in FIGS. 4*a* and 4*b*. Shaft 11 has a series of slots 41 that receive blades 14 in abutting fashion. Over the tip of shaft 11 goes a cap tip 26 similar to the cap 26 shown in FIG. 1. The cap 26 screws onto screw threads 25 which are now disposed on the end of shaft 11 rather than on the blade tips 23 as is done in the previous embodiment of FIGS. 1-3. Its purpose is the same, to keep the blades 14 in alignment and in place. This form of head 13 arrangement is not removable as the head arrangement shown in FIGS. 1-3. The end of this shaft 11 as shown here has a pull knob 40 instead of the pull string and ring 28, though either on can be used.

Figure 5:
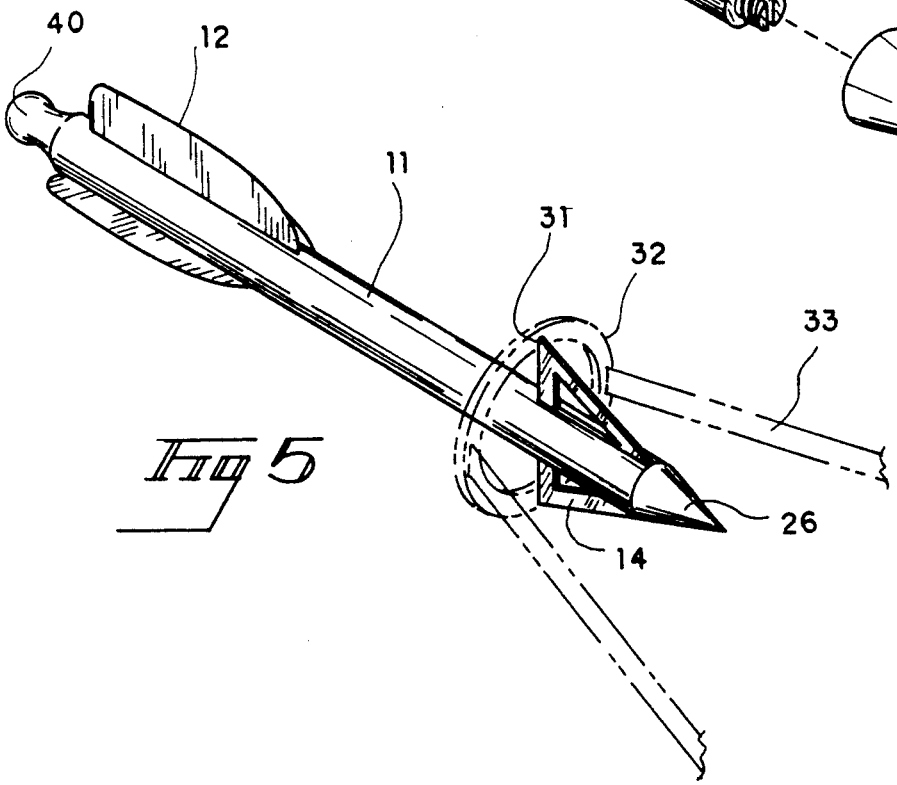
FIG. 5 is a perspective view which shows the alternate embodiment used in an alternate launching device.

The back ends 30 of the blades 14 should present a flat, even surface. These back ends 30 are to be mounted in notches 31 on a circular ring 32 which forms the launching seat on a modified slingshot 33 as shown in FIG. 5. The notches 31 are cut only partially into the ring 32 to retain the blades 14 and therefore the projectile in one position. The user of the slingshot 33 and projectile 10 then grasps the pull line 28 or grasping knob 40 and draws back on it to give a tension force to the slingshot which will allow the launching of the projectile 10 when the pull line 28 or knob 40 is released. The ring 32 is wide enough to allow the flight feathers 12 through when the projectile is released. Arm guards can be utilized when using the dart 10 and slingshot 33 as would normally be used in any form of activity resembling archery. Alternatively, the grasping means 29 provided may be used in combination with known mechanical release devices. While such devices are known and used to release bow strings and the like, grasping means 29 of projectile 10 provides for the direct use of such a device to aid in the release and launch of projectile 10.

The advantage of the above described device is that it allows for the firing of a bladed projectile having an elongated shaft and flight feathers for stability without the necessity of using a cumbersome device such as a bow. The bladed dart projectile of the present invention is capable of being launched in a much smaller space than a conventional bow and arrow arrangement. This allows a user of the device, such as a hunter, a greater ability to hide and cover himself from prey. The launching slingshot is also quite a bit faster to use than a normal bow and requires less movement.

It is to be understood that the present invention is not limited to the sole embodiment described above, but encompasses any and all embodiments within the scope of the following claims.

I claim:

1. A bladed dart projectile for use with a manually energized launching device, comprising;

an elongated hollow shaft having a forward end and an aft end, said hollow shaft aft end having a plurality of flight feathers disposed axially thereon, said hollow shaft forward end containing a closely fitting hub, said hub having an aft end providing attachment for a pull line extending through said hollow shaft, and the aft end of said pull line extending from said hollow shaft aft end and providing means adaptable to a mechanical release device for the drawing of said shaft for the launching of said projectile.

2. The projectile of claim 1 wherein;

said means for drawing said shaft comprises a ring.

3. The projectile of claim 1 wherein;

said hub has a forward end containing a plurality of radial slots, said slots providing for the frictional attachment of a corresponding number of blades, each of said blades having a forward tip, axial edge, normal edge and angular cutting edge, the corners formed by said blade axial edges and said blade normal edges frictionally fitting within said hub slots, each of said blade forward tips having a longitudinal edge with threads formed thereupon, said threads forming attachment means for an internally threaded conical tip, whereby said blades may be installed and secured upon said shaft by means of said slotted hub and retained with said axial edges abutting by means of said conical tip.

4. A bladed dart projectile for use with a manually energized launching device, comprising;

an elongated shaft having a forward end and an aft end, said shaft aft end having a plurality of flight feathers disposed axially thereon, said shaft forward end containing a plurality of radial slots, said slots providing for the frictional attachment of a corresponding number of blades, tachment of a corresponding number of blades, each of said blades having a forward tip, axial edge, normal edge and angular cutting edge, the corners formed by said blade axial edges and said blade normal edges frictionally fitting within said slots, each of said blade forward tips having a longitudinal edge with threads formed thereupon, said threads forming attachment means for an internally threaded conical tip, whereby said blades may be installed and secured upon said shaft by means of said slots and retained with said axial edges abutting by means of said conical tip.

5. The projectile of claim 4 wherein;

said elongated shaft aft end is provided with means adaptable to a mechanical release device providing for the drawing of said shaft for the launching of said projectile.

6. The projectile of claim 5 wherein;

said means for drawing said shaft comprises a ring.

* * * * *